United States Patent [19]

Rozon

[11] Patent Number: 5,054,535

[45] Date of Patent: Oct. 8, 1991

[54] VERTICAL BLIND

[75] Inventor: David P. Rozon, Bourget, Canada

[73] Assignee: 139088 Canada Ltee, Quebec, Canada

[21] Appl. No.: 301,319

[22] Filed: Jan. 24, 1989

[30] Foreign Application Priority Data

Feb. 5, 1988 [CA] Canada ..... 558302

[51] Int. Cl.[5] ..... E06B 9/00

[52] U.S. Cl. ..... 160/38; 160/173; 160/176.1; 160/178.1

[58] Field of Search ..... 160/168.1, 176.1, 178.1, 160/173, 177, 900, 38, 39

[56] References Cited

U.S. PATENT DOCUMENTS

| | | | |
|---|---|---|---|
| 2,996,115 | 4/1961 | Kenz | 160/168.1 |
| 3,038,534 | 6/1962 | Cayton | 160/173 |
| 3,299,943 | 1/1967 | Poe | 160/176.1 |
| 3,996,988 | 12/1976 | de Wit | 160/176.1 X |
| 4,114,673 | 9/1978 | de Witt et al. | 160/173 |
| 4,193,438 | 3/1980 | Pastore | 160/166.1 |
| 4,214,622 | 7/1980 | Debs | 160/168.1 |
| 4,261,408 | 4/1981 | Debs | 160/176.1 |
| 4,262,728 | 4/1981 | Debs | 160/168.1 |
| 4,267,875 | 5/1981 | Koks | 160/176.1 |
| 4,293,021 | 10/1981 | Arena | 160/178.1 |
| 4,316,493 | 2/1981 | Arena | 160/168.1 |
| 4,350,197 | 9/1982 | Haller | 160/166.1 |
| 4,356,855 | 11/1982 | Holzer | 160/178.1 |
| 4,381,029 | 4/1983 | Ford et al. | 160/172 |
| 4,381,811 | 5/1983 | Frentzel et al. | 160/168.1 |
| 4,425,955 | 1/1974 | Kaucic | 160/168.1 |
| 4,449,564 | 5/1984 | Hansen et al. | 160/166.1 |
| 4,653,564 | 3/1987 | Marocco | 160/168.1 |
| 4,688,618 | 8/1987 | Saicheck et al. | 160/168.1 |

FOREIGN PATENT DOCUMENTS

| | | | |
|---|---|---|---|
| 517182 | 10/1955 | Canada . | |
| 800384 | 12/1968 | Canada . | |
| 1053142 | 4/1979 | Canada . | |
| 1078298 | 5/1980 | Canada . | |
| 1097208 | 3/1981 | Canada . | |
| 1153686 | 9/1983 | Canada . | |
| 1161356 | 1/1984 | Canada . | |
| 1173736 | 9/1984 | Canada . | |
| 1185165 | 4/1985 | Canada . | |
| 1207060 | 7/1986 | Canada . | |
| 3611857 | 10/1987 | Fed. Rep. of Germany | 160/176.1 |

*Primary Examiner*—David M. Purol

*Attorney, Agent, or Firm*—Fish & Richardson

[57] ABSTRACT

A vertical blind with an arrangement for supporting a plurality of vanes comprised of an elongate blind head with a plurality of slidable vane carriers disposed therein, each adapted to rotate an individual vane about its vertical axis. Rotational movement of the vanes is effected by providing the blind head with a central rotatable tilt rod that engages a series of face gears disposed within each of the carriers. Each carrier also includes a pinion gear engaged by the face gear and mounted to a vane holder adapted to rotate within a clip provided on the carrier. The vertical blind may also include a plurality of slinding clips linking the carriers, the clips being readily removable from the carriers. The clips may include fastening arrangements which enable adjustment of the spacing between the carriers so as to provide a vertical blind capable of fitting within different dimensions. The vertical blind may also include a plurality of valence clips for attachment of a decorative valence. These valence clips releasably mount to rails attached to the blind head by mounting plates that attach behind an extending portion of the rails. The vertical blind may also include a head with an arrangement of interlocking grooves and rails that allows a plurality of heads to be releasably attached together in order to form a single rigid transportable unit.

3 Claims, 7 Drawing Sheets

VERTICAL BLIND

BACKGROUND OF THE INVENTION

This invention relates to a vertical blind of the type in which vanes are suspended from a blind head and are capable of traversing the head and rotational movement to control the amount of light passing through the blind.

Vertical blinds are known wherein individual vanes are suspended by carriages traversing a blind head. The carriages in such a blind are linked together by slidable clips that limit the distance between the carriages. A variety of means for rotating the vanes to control the passage of light through the blind are known. Debs, Canadian Patent 1,153,686 and Klenz, U.S. Pat. No. 2,869,636 disclose vertical blinds wherein the vanes are rotated by means of a centrally-disposed rotatable tilt rod, rotation of which effects rotation of the individual vanes. In Klenz, this rotation is effected by way of cooperating edge gears and in Debs said rotation is effected by means of co-operating bevel gears. These gear means have the disadvantage of bulkiness, difficulty of manufacture, and with respect to edge gears, rapid wear and imprecision of fit. Debs discloses in addition a decorative valence clip attaching to rails in the blind head by means of a spring clip that must be fitted with a screwdriver or other tool. It is also known to link the individual vane carriages by means of clips that are fixedly attached at one end thereof to a vane carriage. Said attachment gives rise to the attendant disadvantage of requiring two separate carriage types, mirror images of each other, where it is desired to construct a vertical blind whose vanes are capable of opening from the middle. In addition, replacement of such a clip necessitates replacement of the entire carriage connected thereto.

SUMMARY OF THE INVENTION

The present invention consists of an arrangement for supporting a plurality of vanes of a vertical blind including a novel gear means for effecting rotation of the vanes, consisting of a centrally-disposed rotatable tilt rod, rotation of which effects rotation of a plurality of face gears, each disposed within a slidable vane carrier. Rotation of the face gears effect rotation of corresponding spur gears fixedly mounted to individual vane holders, the teeth of which spur gears are oriented perpendicular to the teeth of said face gears. Another feature of the invention consists of a decorative valence clip adapted to be mounted on a blind head by means of a mounting element of substantially circular shape adapted to be engaged by rails mounted on the blind head and engaged thereby by a cam action. Another aspect of the invention consists of fully-removable flexible clips that serve as slidable spacers for the vane carriages and that may include stop means adapted to allow the user to adjust the spacing between the carriages, and wherein said carriages include means for engaging the stop means. According to another feature of the invention the blind head has a pair of oppositely disposed grooves oriented along the longitudinal axis of the blind head, as well as a pair of oppositely disposed rails parallel to said grooves, the rails being adapted to engage co-operating grooves in a second blind head so as to form a rigid unit comprising linked blind heads for purposes of shipping.

DESCRIPTION OF THE PREFERRED EMBODIMENT

Figure 1:
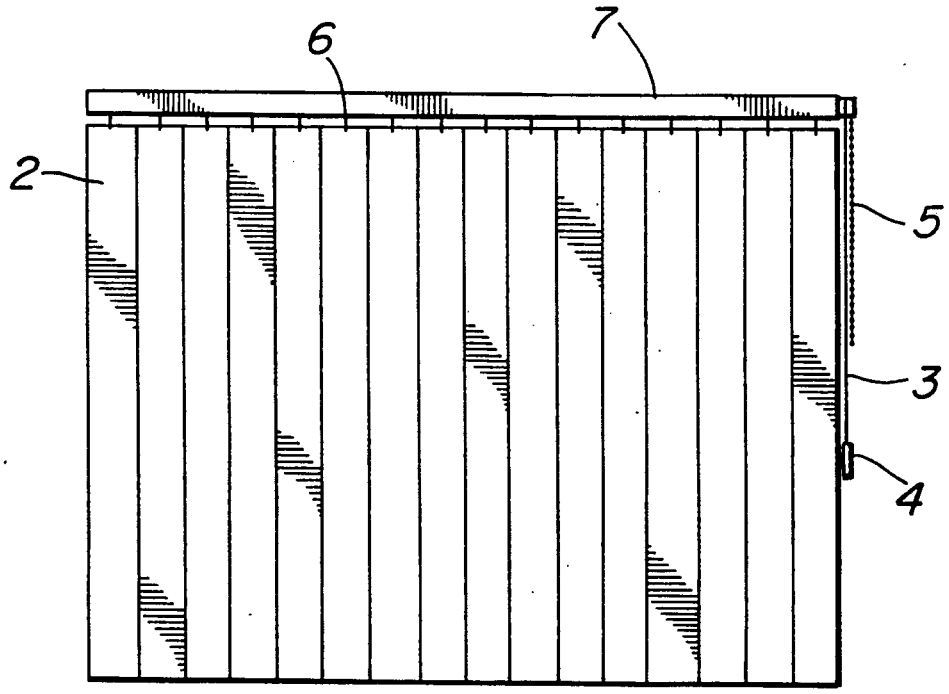
FIG. 1 is a front elevational view of a vertical blind according to the present invention showing the blind in a fully closed position.

Referring to the drawings in detail, FIG. 1 shows a vertical blind according to the invention in a fully closed position. The blind can be installed inside a window frame or attached to a ceiling or wall. The vertical blind comprises a head 7 adapted to be attached to a window frame, ceiling or wall by brackets, not shown, holders 6 adapted to attach the vanes 2 to carriers within the head, a pull cord 3 to which is attached a counterweight 4, cord 3 being adapted to pull the vanes 2 open and shut; and a pull chain 5 that rotates the individual vanes about vertical axes.

Figure 2:
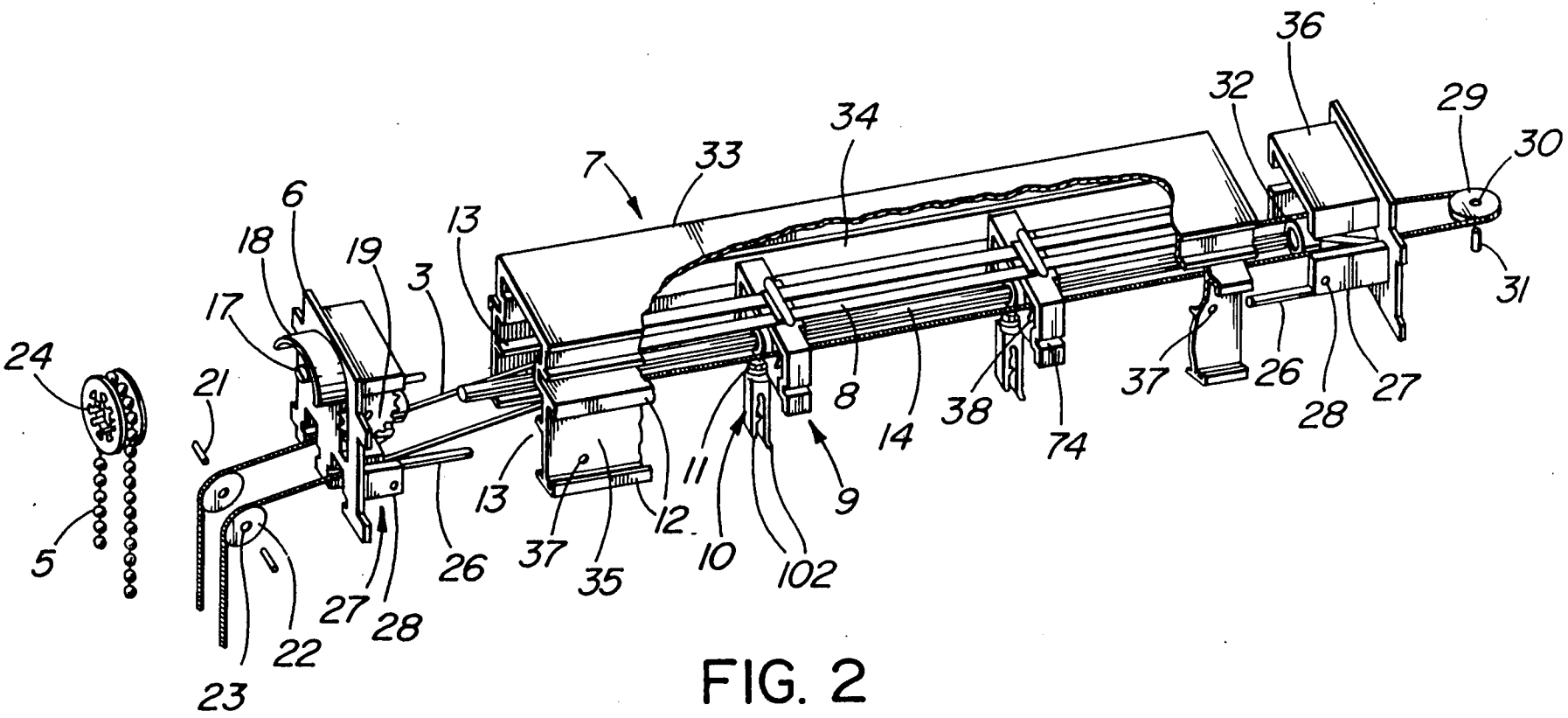
FIG. 2 is an exploded view, in perspective, of the blind head.
Figure 9:
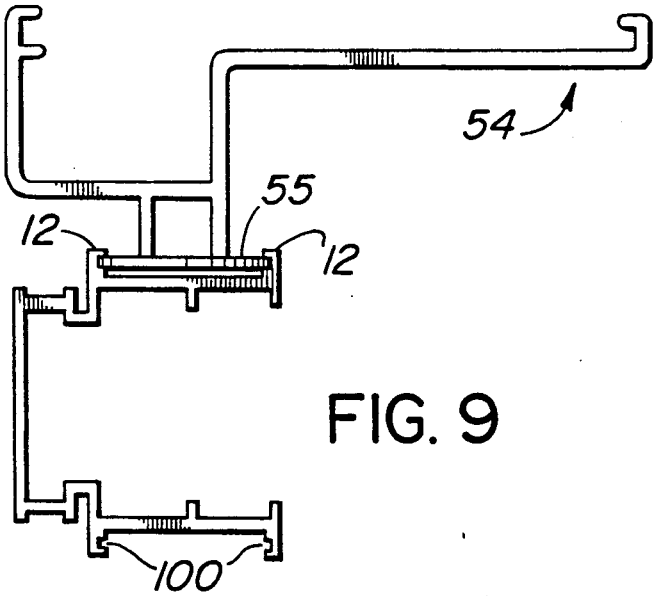
FIG. 9 is a cross-sectional view of the blind head with a decorative valence clip in place.
Figure 10:
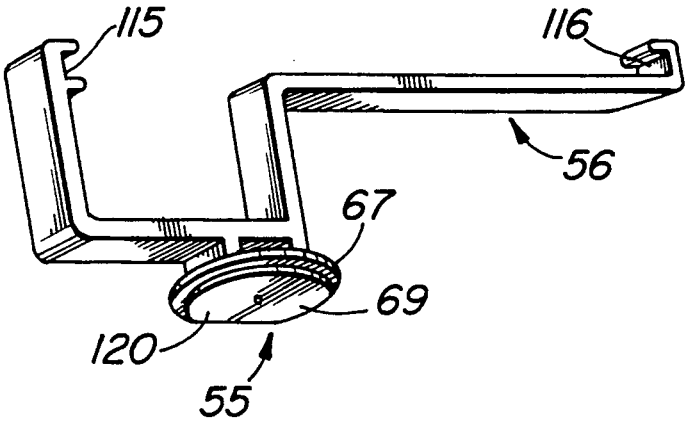
FIG. 10 is a perspective view of a decorative valence clip according to the present invention.

Referring to FIG. 2, the blind head 7 is generally box shaped, with a top wall 33, rear wall 34 and front wall 35. The bottom side of the box is open. Extending outwardly from wall 35, and preferably integral therewith, are parallel, spaced apart, longitudinally extending rails 12. The rails 12 are provided with opposed grooves 100, as best seen in FIG. 9, in which may be secured a decorative strip of metal, plastic, or other suitable material. The decorative strip (not shown) would have a width such that its opposite edges would be secured in the grooves 100 and it would preferably have about the same length as the blind head. The rear wall 34 is also provided with grooved rails 12, which may be identical to the grooved rails 12 on the front wall 35 and may be used for the same purpose.

Figure 7:
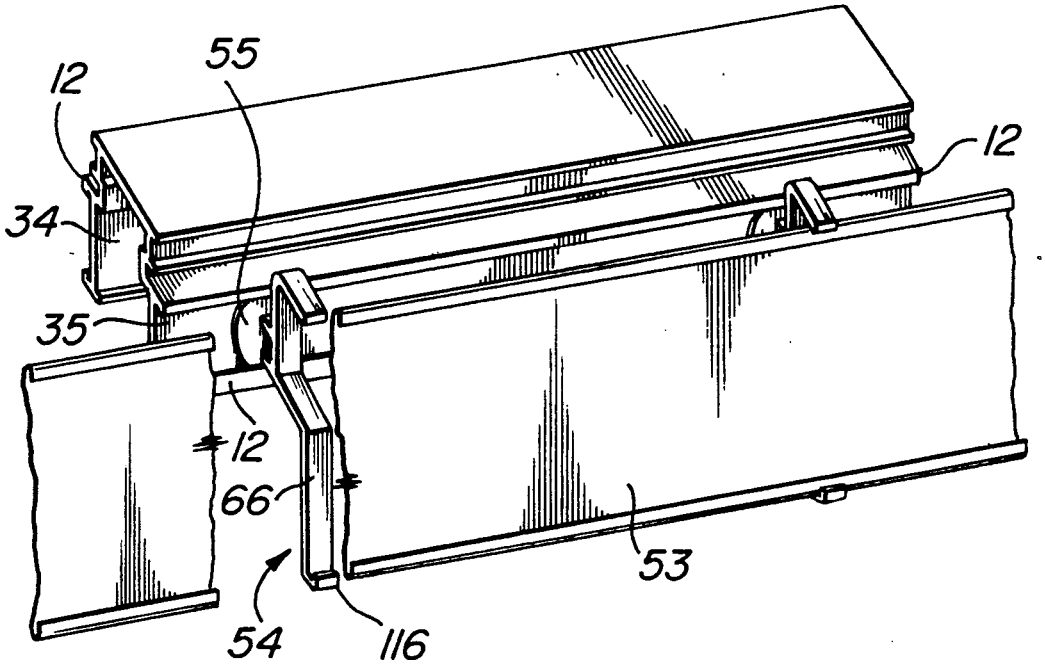
FIG. 7 is a perspective view of a portion of the blind head showing a decorative valence and valence clips for securing the valence to the blind head.

The grooved rails 12 may also be used to secure valence clips 66 as shown in FIG. 7 and as will be further described below. Each of the vane carriers 9 includes a clip-type holder 10 having resilient arms 102 (see also FIGS. 3 and 4) adapted to grip and hold an end of a vane and has a pair of grooves 74 for engagement with support rails 13 extending inwardly from the front and back walls 35, 34 of head. Slotted clips 8 are connected between adjacent vane carriers 9 which, as aforesaid, are adapted to move slidably within head 7, and to engage the individual vanes by means of holders 10. Clips 8 connect the adjacent vane carriers 9 to each other and limit their travel relative to each other. Clips 8 also provide a means for sequentially sliding all the vane carriers within the head from an open blind position adjacent one end to completely cover most of an underlying window in a closed blind position. Tilt rod 14 is disposed between sides 34 and 35 of head 7 and attaches rotatably to end units 6 and 36. It passes through holes in the vane carriers and, when rotated, causes the holders 10 (and attached vanes) to be "tilted", i.e. rotated about vertical axes to adjust their orientation and hence vary the amount of light entering the window. Tilt rod 14 preferably includes axially extending strengthening ribs. Tilt rod 14 also contains an axially extending groove (wider spacing between two ribs) adapted to engage drive gears in the vane carriers.

Blind head 7 is fitted at one end with an end unit 6 including a gear mechanism 19 for turning tilt rod 14. Opposing end unit 36 contains a sleeve 32 for the free rotation therein of tilt rod 14 and a pulley 29 for engagement of a pull cord 3. End units 6 and 36 may be constructed of plastic or other suitable material and can be snapped into head 7 by squeezing together arms 27 and pushing the units into the open ends of head 7 until pins 28, located on opposite sides of each arm 28, snap into corresponding holes 37 in the walls of head 7.

Figure 11:
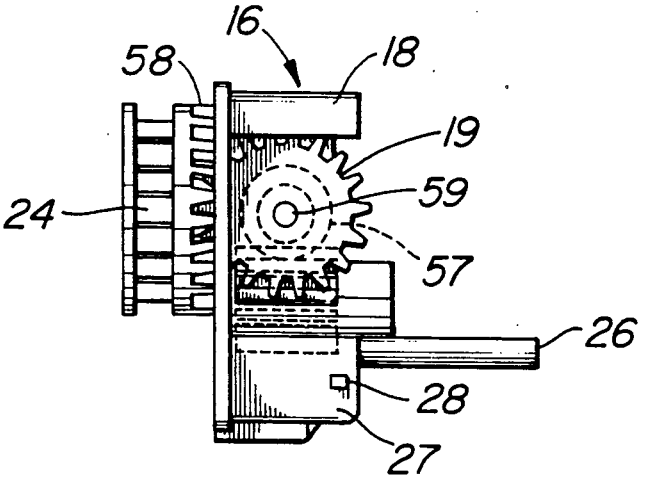
FIG. 11 is a cut-away side view of an end piece of the blind head illustrating the tilt rod turning mechanism.
Figure 12:
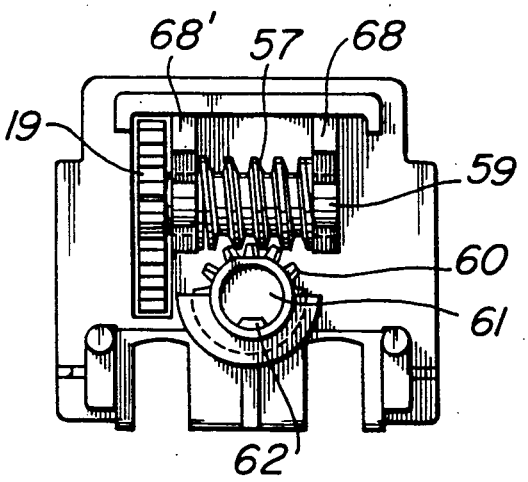
FIG. 12 is a front view of the end piece shown in FIG. 11.

Referring to FIGS. 11, and 12, end unit 6 has a drive pulley 24 that is adapted to be rotated by chain or cord 5 (FIG. 2). Pully 24 is mounted rotatably on pin 17 and is adapted to engage pinion 19 by means of gear teeth 58. Pinion 19 is coaxially mounted on a shaft 59 carrying a worm gear 57. Worm gear 57 and its associated pinion 19 are removably attached to end unit 6 by means of removable attachment of the ends of shaft 59 within clips 68 and 68'. Worm gear 57 engages with gear 60, which consists of a hollow sleeve encircled by gear teeth adapted for engagement with worm gear 57. Hollow opening 61 within said sleeve includes key member 62 adapted to engage tilt rod 14 for rotatable movement thereof. Additional key members and corresponding slots in tilt rod 14 may be included for additional stability. Pegs 26 extending inwardly into head 7 from end units 6 and 36 serve to keep vane carriers 9 spaced sufficiently from the end of head 7 to prevent the vanes from hitting an abutting wall or window frame. Movable parts including pulley 24 and shaft 59 with gears 19 and 57 are all readily removable for replacement when worn. These parts can be assembled or disassembled without special tools or skills by simply cliping them into their respective slots or engaging them on their respective pegs.

Movement of carriages 9 slidably within head 7 is effected by an endless cord 3 disposed within head 7 and extending through openings in end unit 6 for operation by the user. Cord 3 passes through apertures 38 (FIG. 3) disposed on opposite sides of vane carriers 9. Equal spacing of apertures 38 from tilt rod 14 ensures a minimum of torsional forces affecting carrier movement during opening or closing of the blind. Pulleys 29 and 22 are mounted for rotation on pins 31, 21, respectively in end units 36 and 6 to ensure smooth movement of cord 3.

Figure 3:
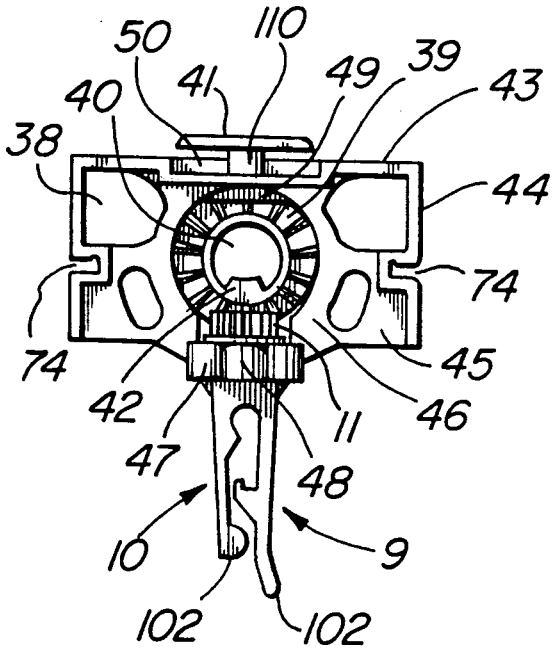
FIG. 3 is a front view of a vane carrier forming part of the blind head.
Figure 4:
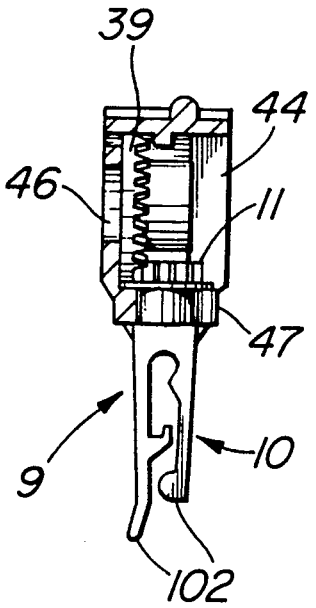
FIG. 4 is a cross-sectional side view of a vane carrier.
Figure 5:
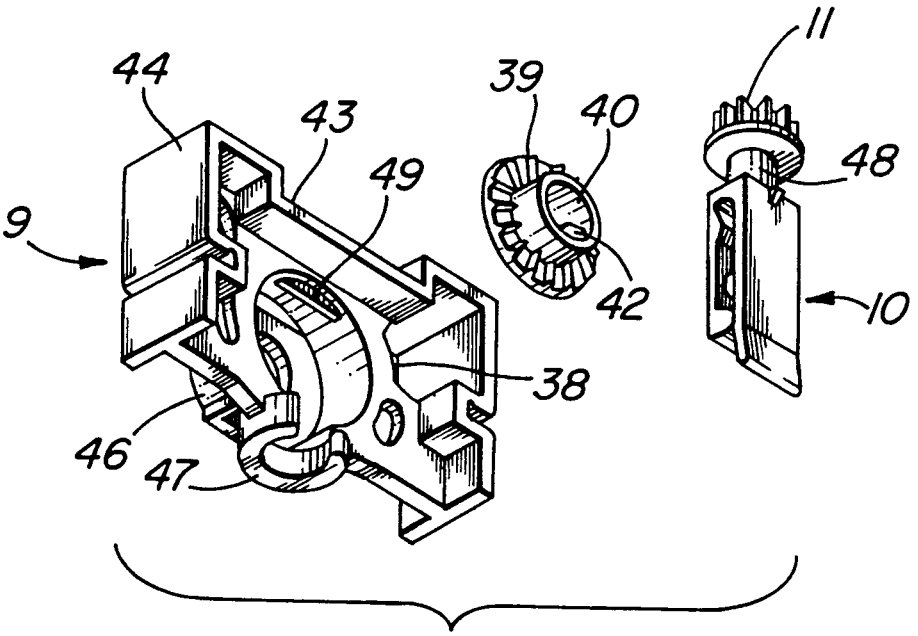
FIG. 5 is an exploded view, in perspective, of a vane carrier.

Referring to FIGS. 3, 4 and 5, each vane carrier 9 is comprised of an upper wall 43 and two side walls 44 adapted to fit within head 7. Internal webs 45 connect walls 44 with a central gear housing 46. Gear housing 46 supports face gear 39 which is adapted to be rotated by tilt rod 14. Face gear 39 includes a circular central opening 40 with a key element 42 adapted to engage a corresponding slot in tilt rod 14. Additional key elements and corresponding slots may be included for additional stability. Face gear 39 is held within housing 46 by holder 49 and spur gear 11. Vane holder 10 which carries pinion 11, is detachably attached to carrier 9 by means of the generally C-shaped clip 47, which is integral with webs 45 and housing 46. Clip 47 releasably engages shank 48 of vane holder 10 having spaced apart legs 102. Spur gear 11 formed at the top end of shank 48 is adapted to engage face gear 39, rotation of which accordingly rotates the vane holder 10 and any attached vane 2. Apertures 38 receive cord 3 as it passes along the length of blind head 7. Carrier 9 includes a t-shaped clip 41 extending above upper wall 43, which clip is adapted to releasably engage sliding clips 8.

Figure 6:
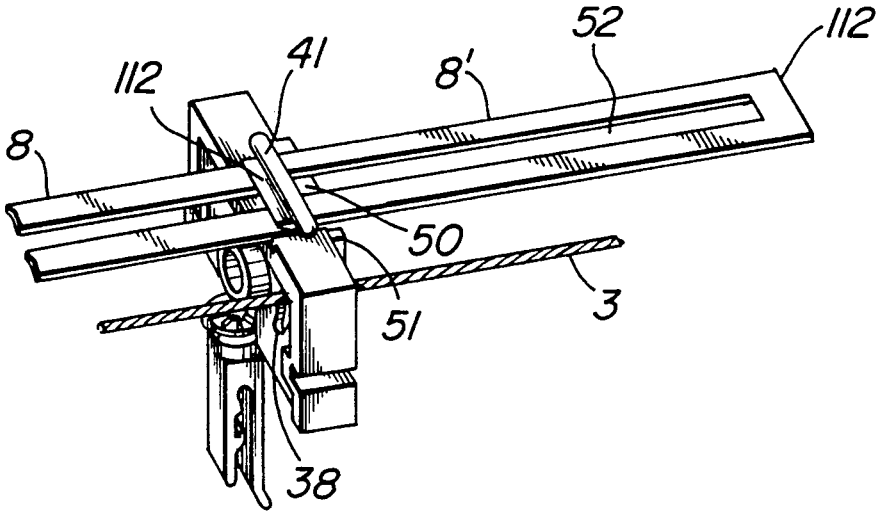
FIG. 6 is a perspective view of a vane carrier including the pull cord and spacer strips of the blind head.

Referring to FIG. 6, it will be seen that two sliding clips 8 and 8$^1$ are attached to t-shaped clip 41. Clip 8$^1$ overlies clip 8. The end of the lower clip 8 is retained within a shallow indentation 50 in carriage 9. Movement of the lower clip 8 to the right relative to carriage 9, as viewed in FIG. 6, is blocked by wall 51; movement to the left is prevented by t-clip 41. The upper connecting clip 8$^1$ is free to slide to the left relative to carrier 9 by virtue of longitudinally extending slot 52. The two side legs of clip 8$^1$ (and clip 8 which is identical thereto) which define slot 52 pass on opposite sides of the support post 110 of t-clips 41 (FIG. 3). As can be seen in FIG. 6, the clip 8$^1$ has end portions 112 defining end limits for slot 52. Slots 52 allow carriages 9 to abut each other or move apart as far as the length of the slot 52. Connecting clip 8, formed of resilient material such as plastic, can be installed or removed from t-shaped clip 41 by a simple twisting motion to bring the axis of slot 52 in line with the longitudinal axis of t-shaped clip 41. This feature allows easy assembly and repair of the device and provides for the construction of a vertical blind that requires only a single type of carriage and connecting clip, whether the blind opens from the side or from the middle.

The vane carriers 9 are linked by connecting clips 8. Cord 3 is used to effect slidable movement of the carriers 9 sequentially. Where it is desired that the blind opens from one side, the free ends of cord 3 are each tied in a knot, the two knots being disposed on opposite sides of an aperture 38 of end carrier 9 remote from end unit 6. Of course the knots are made large enough that they cannot pass through aperture 38. Where it is desired that the blinds open from the middle, the free ends of cord 3 are tied in a knot as above at one of the middle carriers. The cord is fastened by small metal crimps to an adjacent carrier at the opposite side of the knots. The two carriers thus define the point at which the vanes open. The opposing motions of the two sides of the cable loop cause the vanes on either side of this point to slide in opposing directions.

Figure 18:
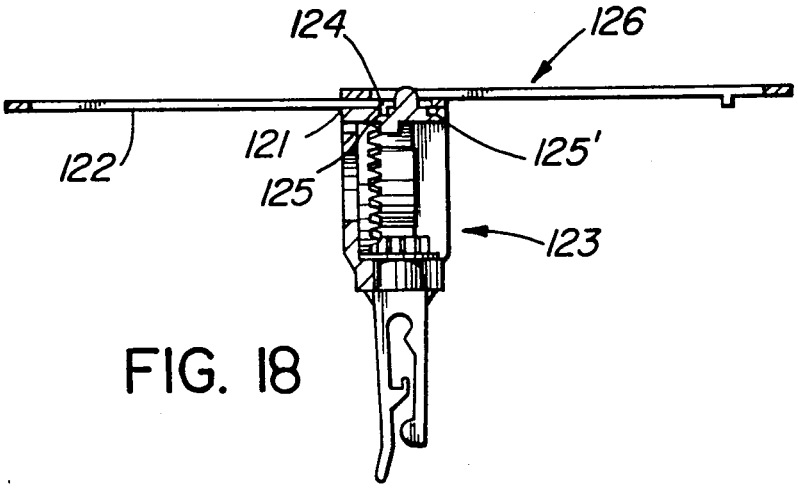
FIG. 18 is a partial cross sectional view of a vane carrier and spacer strips embodying a further aspect of the present invention.

An additional embodiment is illustrated by FIG. 18. This embodiment consists of a vane carrier 123 as described above with a shallow indentation 121 disposed therein comprising a shallow groove traversing the width of the carrier. Lower clip 122 includes pegs 124 depending downward therefrom on respective sides thereof. Clip 122 is releasably attached to vane carrier 123 by means of pegs 124 which fit within corresponding holes 125 in the vane carrier 123. Clip 126 overlies clip 122. It will be seen that clip 122 may be attached to carrier 123 so as to extend out from the reverse side thereof, by attachment of clip 122 to holes 125' in carrier 123, thereby enabling identical carriers to be used on both sides of a center opening blind. It will be further seen that the present embodiment may comprise a clip and carrier combination as described above wherein two sets of pegs are disposed on the carrier and a set of corresponding holes is disposed within the clip.

Figure 8:
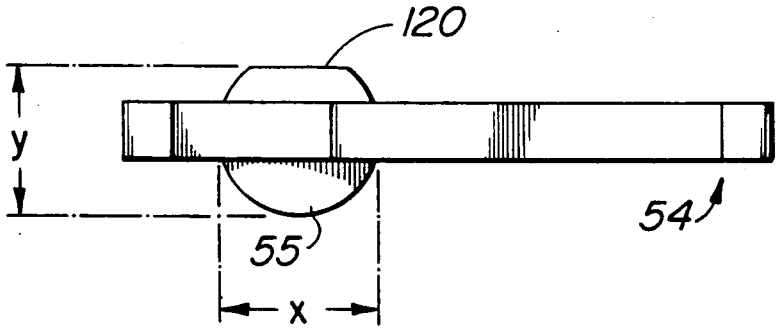
FIG. 8 is a frontal view of a valence clip.

Referring to FIGS. 7, 8, 9 and 10, the decorative valence and clip therefore are shown attached to one side of blind head 7. As mentioned above, the user can attach decorative valences to either or both sides of blind head 7. The decorative valence consists of a decorative strip 53, which, can in fact, be a vane identical to those comprising the body of the blind. The decorative strip 53 is retained in grooves 115, 116 in the holder portion 56 of valence clip 54. A number of valence clips 54, as desired, may be attached to the rails 12 extending along the side walls 34 and 35 of the blind head as described above. In the preferred embodiment, the valence clip 54 is molded of rigid plastic. Valence clip 54 includes an essentially circular mounting element 55 having a flat side 120, as best seen in FIG. 8 adapted to engage rails 12. In other words it is in the form of a truncated disc. Dimension "y" is slightly less than the spacing between rails 12 whereas diameter "x" is slightly greater. Engagement of clip 54 is effected by placing mounting element 55 between rails 12 with flat side 120 parallel to rails 12, rotating valence clip 56 90° to its final position and thereby attaching the mounting element firmly behind rails 12 as best seen in FIG. 9. Mounting element 55 comprises an outer portion 67 that is larger than the inner portion 68. This extension creates a rim that flexes slightly inward when the valence clip is turned to the vertical position, thus allowing the clip to be held rigidly in the vertical position as required to hold the decorative valence 53.

Figure 13:
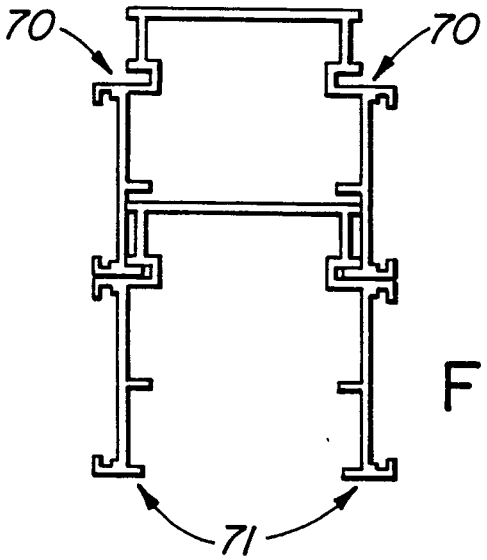
FIG. 13 is a sectional view of two blind heads connected for storage or transportation.

Referring to FIG. 13, the blind heads 7 are adapted to be disassembled and linked together to facilitate transportation and storage. Grooves 70 are adapted to be engaged by rails 71 of a second disassembled blind head, which can in turn receive the rails 60 of a third disassembled blind head. Blind heads thus assembled can be readily transported with reduced risk of damage.

Figure 14:
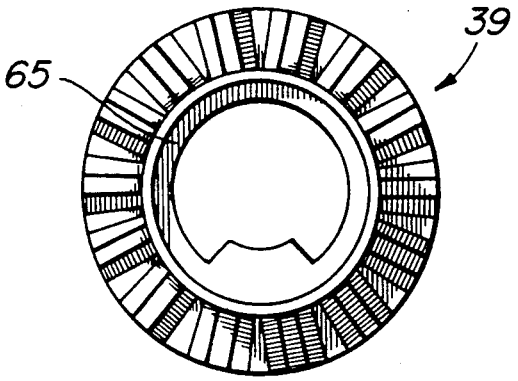
FIG. 14 is an elevational view of a portion of a vane carrier embodying a further aspect of the present invention.

In a further embodiment of the present invention illustrated in FIG. 14, face gear 39 includes an inner sleeve 65 rotatable within the circular opening of face gear 39. Inner sleeve 65 is frictionally engaged by face gear 39, and is adapted to allow adjustment to the tilt angle of individual vanes.

Figure 15:
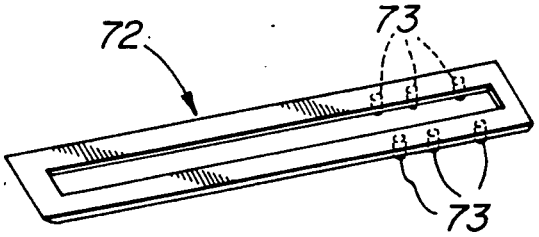
FIG. 15 is a perspective view of a spacer strip embodying another aspect of the present invention.
Figure 16:
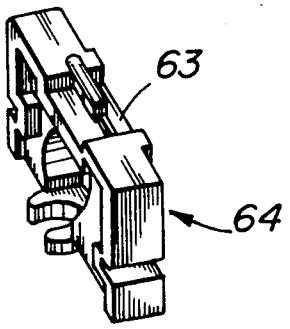
FIG. 16 is a perspective view of a vane carrier embodying this further aspect.
Figure 17:
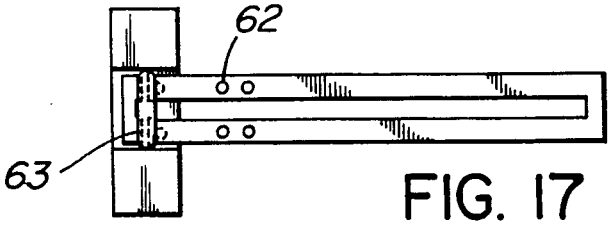
FIG. 17 is a top view of a vane carrier and spacer strip embodying this further aspect.

In another embodiment of the present invention, illustrated in FIGS. 15 to 17, connecting clips 72 include three or more pairs of pegs 73, all of which are oriented in the same direction, perpendicular to the plane of the connecting clip. Pegs 62 are adapted to engage stop 63 in the corresponding carrier 64.

In use, a blind head may contain a plurality of units, consisting of a carrier and its associated connecting clip, of this alternative embodiment. Such a blind head will have two or more vanes spaced closer together than the standard-sized clip would otherwise allow, thereby allowing a greater range of blind sizes to be constructed.

In the preferred embodiment, all the component parts of the vertical blind can be easily assembled or disassembled without special tools or skills. In addition, the individual vane holders can be removed from the blind head without further disassembly thereof.

In operation, the vanes can be pulled open or shut and rotated about their lengthwise axes by means of cord 3 and chain 5 respectively. In the embodiment disclosed herein, both chain and cable are disposed at the same end of the blind for convenience of operation. If desired, however, these two elements can be located at opposite ends of the blind head.

Although preferred embodiments of the invention have been described and disclosed herein, it is to be remembered that various alterations can be made thereto without departing from the true spirit and scope of the invention as defined by the appended claims.

What I claim as my invention is:

1. An arrangement for supporting a plurality of vanes of a vertical blind comprising an elongate blind head, a pair of rails mounted on an external surface of said head and oriented longitudinally thereto, each of said rails comprising an inner portion attached to said surface and transverse thereto and an outer portion in a spaced apart relation to said surface and extending towards the opposing rails thereto so as to form a groove between said outer portion and said surface, and a plurality of valence clips adapted to be releasably engaged to said rails and to releasably engage a decorative valence, said valence clips including a mounting element comprises of an elongate plate adapted to engage said grooves, wherein said elongate plate of said mounting element is shaped to engage said grooves and having a first flat plate element mounted to said clip and a second flat plate element attached to said first plate element, said first plate element overhanging an edge thereof of said second plate element, said overhand flexible for flexing when said mounting element is mounted to said rails so as to provide an outward force in relation thereto.

2. An arrangement as claimed in claim 1 wherein said mounted element is comprised of a truncated disc having a narrow dimension which fits between said outer portions of said rails and having a broad dimension which fits between said inner portions of said rails but not between said outer portions.

3. A vertical blind including a blind head element having a top portion and first and second parallel sides depending from said top portion, each said side having an outwardly open longitudinally extending groove near said top portion, the grooves in said first and second sides being spaced apart a predetermined distance and being parallel to each other, each said side having a bottom edge portion provided with a longitudinally extending rail, said rails being parallel to each other, extending inwardly towards each other, and being spaced apart by substantially said predetermined distance, the rails of said element being engageable with grooves of a second element to form a rigid unit.

* * * * *